United States Patent [19]

Veenstra

[11] 4,315,880

[45] Feb. 16, 1982

[54] MANUFACTURE OF FIBROUS PRODUCTS

[75] Inventor: Uiltje J. Veenstra, Amsterdam, Netherlands

[73] Assignee: Shell Oil Company, Houston, Tex.

[21] Appl. No.: 145,564

[22] Filed: May 1, 1980

Related U.S. Application Data

[63] Continuation-in-part of Ser. No. 73,357, Sep. 7, 1979, abandoned.

[30] Foreign Application Priority Data

Sep. 12, 1978 [GB] United Kingdom ..... 36525/78

[51] Int. Cl.[3] ..... B29F 5/00

[52] U.S. Cl. ..... 264/119; 264/126; 264/288.8; 264/291; 264/DIG. 47; 264/122

[58] Field of Search ..... 264/119, 126, 288, 291, 264/122, DIG. 47

[56] References Cited

U.S. PATENT DOCUMENTS

| | | | |
|---|---|---|---|
| 3,555,136 | 1/1971 | Rouault | 264/122 |
| 3,619,460 | 11/1971 | Chill | 264/288 |
| 3,882,063 | 5/1975 | Gouw | 264/288 |
| 4,197,148 | 4/1980 | Shinomura | 264/288 |

FOREIGN PATENT DOCUMENTS

| | | |
|---|---|---|
| 2361909 | 6/1975 | Fed. Rep. of Germany . |
| 2728351 | 1/1978 | Fed. Rep. of Germany . |
| 1328090 | 8/1973 | United Kingdom . |
| 1364442 | 8/1974 | United Kingdom . |

*Primary Examiner*—James R. Hall

*Attorney, Agent, or Firm*—Martin S. Baer

[57] ABSTRACT

Process for the manufacture of fibrous products by drawing at elevated temperature a sheet comprising sintered particles of a synthetic organic thermoplastic polymer, which sheet also contains 0.1 to 5 phr of a processing aid, being certain fatty acids or compounds thereof.

5 Claims, No Drawings

MANUFACTURE OF FIBROUS PRODUCTS

This application is a continuation-in-part of Ser. No. 6/073,357, filed Sept. 7, 1979, now abandoned.

The invention relates to a processs for the manufacture of fibrous products by drawing at elevated temperature a sheet comprising sintered particles of a synthetic organic thermoplastic polymeric material. Such sheet is referred to herein as sintered sheet. The invention also relates to fibrous products so manufactured.

A process of this kind is described in U.S. Pat. No. 3,882,063, which also disclosed that various fillers such as quartz, glass powder, clay, talc, carbonates, wood pulp, dye stuff, metal oxides and metal salts, may be present in the sheet to be drawn.

According to the process employed in this invention, uniform fibrous webs are produced by depositing a layer of particles of thermoplastic resin, or mixtures of such particles with organic or inorganic fillers, on a surface, and exposing the layer to conditions at which the thermoplastic particles are heated sufficiently to be fused to each other without being completely melted into a homogeneous sheet. The result is a sheet of partially fused thermoplastic particles. This sheet is then subjected to a drawing process which spontaneously converts the fused sheet into a fibrous web. The fibrous web can be used as such, e.g., for packaging, or as material for disposable articles, or it may be further converted by known methods, such as by cutting or stretch-breaking, into staple fibers or, such as by grinding or chopping and subsequent refining, into fibers of the type of pulp used in paper making.

If filler is present in the starting mixture, it remains in the product but is not completely distributed within the thermoplastic particles; it is in part fused to the surface of the thermoplastic material of the fused sheet and of the resulting fibrous web.

It has now been found that significant advantages in relation to the process and to the fibrous products manufactured by the process can be obtained by addition of suitably selected compounds of certain types, referred to herein as processing aids, if they are incorporated in suitable amounts.

Accordingly, the invention provides a process as described above, in which the sintered sheet also contains, per 100 parts by weight of polymeric material, 0.1-14 5 parts by weight of a processing aid having the formula $(R^1—COO)_nR^2$, in which $R^1$ is a saturated or unsaturated aliphatic hydrocarbyl group having 10–20 carbon atoms, n is an integer, which may be 1, 2 or 3, and $R^2$ is a hydrogen atom, a metal atom, or an organic radical.

An advantage encountered when carrying out the present process is the reduced tendency to accidental breakage of the sintered sheet during drawing at elevated temperature. This is particularly important when the process is carried out continuously.

Another advantage becomes evident when the sintered sheet contains one or more fillers of types which are not processing aids. When such sheets do not also contain processing aids, part of the fillers tend to get detached from the sheet during drawing at elevated temperature, which leads to loss of filler and dust formation. The extent to which this phenomenon occurs depends on the type and amount of filler and on the processing conditions. Irrespective of the type and amount of the filler and the processing conditions, when carrying out the process in accordance with the invention, the undesirable loss of filler is at least substantially reduced and often completely avoided. This advantageous effect can be illustrated quantitatively by the filler retention, i.e., the percentage by weight of filler retained in the fibrous product resulting from the process.

The present process has the additional advantage that it yields a product consisting of fibers which are finer, have a narrower size distribution and have a softer feel as examined by hand, then fibers produced from sintered sheet which does not contain processing aids.

The fillers which are employed in the process of the invention may be those conventionally employed for the contemplated use. They may be inorganic compounds such as those disclosed in U.S. Pat. No. 3,882,063. They may be employed in very low or very high concentration, depending on the type and intended use, as further described in said patent and generally known in the art. A usable broad range of filler concentration is from 0.5 to 100 phr (part by weight per 100 parts of the thermoplastic resin). The preferred range of concentration of conventional inorganic fillers for most uses is from 15 to 50 phr. The corresponding weight percentages for a total composition are about 0.5 to 50% filler and 99.5 to 50% resin for the broad range and about 13 to 33% filler and 87 to 67% resin for the preferred range.

In the process of this invention, the sheet which is drawn contains, in addition to particulate filler, 0.1–5, and preferably 0.2–5 parts by weight of processing aid per 100 parts by weight of polymeric material.

The processing aid $(R'—COO)n\ R^2$ is a compound of a saturated or unsaturated fatty acid of 11 to 21 carbon atoms, i.e., R′ is an aliphatic saturated or unsaturated hydrocarbyl group of 10 to 20 carbon atoms. $R^1$ preferably represents undecyl, tridecyl, pentadecyl, or heptadecyl. In other words, the $R^1COO$ group is preferably a laurate, myristate, palmitate or stearate radical. The processing aid may be the fatty acid itself, in which $R^2$ represents H. It is perferably a salt of an alkali metal, alkaline earth metal or aluminum, i.e., $R^2$ represents one of these metals and n is a number which corresponds to the valence of the metal. The most preferred processing aids are calcium stearate, aluminum stearate and stearic acid.

Examples of processing aids $(R^1—COO)_nR^2$ in which $R^2$ represents an organic radical, are esters of mono- or polyfunctional alcohols, which alcohols may be partially or completely esterified. The organic radical $R^2$ preferably has not more than 5 carbon atoms, a suitable example being glycerol monostearate.

In the production of fibers from sintered sheet according to this invention, optimal results are obtained if the sheet has a high uniformity; this is promoted by a good dispersion of the various ingredients in the sheet. A suitable way of achieving this is the following. A powdery mixture is made of the synthetic organic thermoplastic polymeric material, the processing aid and any other desired ingredients, e.g., by means of high-speed mixing equipment. The mixture is then deposited onto a surface, which may have been pretreated with a release agent, followed by sintering of the polymeric material by heating. Suitable heating methods comprise infra-red radiation, or the heating of the surface on which the powder is deposited.

The sintered sheet, obtained by any suitable method, is converted into a fibrous product by drawing it at elevated temperature. This is suitably carried out while the sheet is still hot as a result of the sintering step. Alternatively, the sheet may be cooled and at a later stage be heated to a temperature suitable for the drawing operation.

The process may be carried out continuously, e.g., by deposition of the powdery mixture onto a moving surface, such as an endless belt or a rotating drum. It is desirable to distribute the powder evenly over the surface by applying a suitable dosing technique, e.g., by giving the powder particles an electric charge and grounding the moving surface, which for this purpose should be electrically conductive. Drawing of the sheet thus formed may suitably take place by pulling it off from the surface at a speed higher than the linear speed of the moving surface.

In general, mono-axial as well a bi-axial drawing is possible, depending on the nature of the end-product desired. Various suitable drawing methods are well known in the plastics processing art.

The process of the invention is suitable for the manufacture of fibrous products from various synthetic organic thermoplastic polymeric materials. However, the highest benefit is obtained when using as such materials homo- and copolymers of mono-olefins such as ethylene and propylene, in particular polypropylene, the latter being well known for its suitability as base material for fibrous products. Commercially available types of polyolefins are suitable for use in the invention. This includes high density polyethylene, low density polyethylene and so-called isotactic polypropylene.

Although in principle there are no limitations to the particle size of the starting polymer, handling of the polymer and formation of the fibrous web are optimal when employing polymer particles having a particle diameter in the range of from 5 to 100 μm.

If a filler is present in the starting mixture, the best filler retention is obtained when its particle diameter is in the range of from 0.1 to 20 μm.

The fibrous products obtained by the present process usually comprise fibers having a certain degree of interconnection. After cooling they may be used as such for various applications or may first be converted into individual fibers in any suitable manner. The fibrous products as such may, for example, be used for packaging purposes or as material for disposable articles. Both the fibrous products as they are obtained, if necessary after suitable post-treatment such as coating or sizing, and individual fibers made from the fibrous products may be advantageously employed for the preparation of pulp, an aqueous dispersion which is a starting material for paper manufacture. The pulp may be fully synthetic, i.e., prepared from fibrous products obtained by the present process, or partly synthetic, i.e., prepared from a mixture of said fibrous products and natural fibers.

The invention is illustrated by the following Examples.

EXAMPLE 1

In a high-speed mixer a mixture was made of 100 parts by weight of polypropylene powder of melt index 3.5 and particle diameter 60–70 μm, 40 parts by weight of barium sulphate and 2 parts by weight of calcium stearate. A 50 cm wide endless moving steel belt was covered with a very thin layer of talc powder, to act as release agent, which was supplied from a hopper and spread over the belt surface by means of a felt strip. The powdery mixture was deposited by gravity from a hopper in a quantity of 830 g/m$^2$ surface area to a layer thickness of 1.5 mm. The belt was passed through a 15 m long heating tunnel whose temperature amounted to 190° C., at a speed of 7.5 m/min. As a result of the heat supply in the heating tunnel the temperature of the belt at the lace where the powder was deposited amounted to 120° C. On leaving the heating tunnel the sheet formed was taken off from the belt at a linear speed 25 times the linear speed of the belt. Thus a fibrous sheet was obtained having a weight of 10 g/m$^2$, which sheet was cooled in water.

In Table 1 an appraisal is given of some features of the process and the product obtained by the process. Three of these features are rated by one of the figures 1–5, 1 representing the lowest and 5 the highest rating. The rating of the fibrous product formation includes the appraisal of the uniformity of sheet formation and the absence of breakage of the sheet. For the characterisation of the fibrous product quality, its fineness and narrow size distribution were taken into consideration. By fibrous product softness is meant its softness of feel as examined by hand by a person not aware of the source of the product.

Comparative Example A

The process of Example 1 was carried out using a mixture similar to that in Example 1, but without calcium stearate being present.

TABLE I

| Example | 1 | A |
|---|---|---|
| Fibrous product formation, rating | 5 | 3 |
| Fibrous product quality, rating | 5 | 2 |
| Fibrous product softness, rating | 4 | 2 |
| Filler retention, % w | 75 | 19 |

What is claimed is:

1. In the process for the manufacture of fibrous particles which comprises depositing on a surface a layer of powdery particles consisting at least to the extent of 50% by weight of thermoplastic resin and containing between 15 and 50 phr of a particulate inorganic filler having particle diameters in the range from 0.1 to 20 μm, maintaining the layer under sufficient heat for a sufficient length of time to form a sheet of partly fused particles, and drawing the sheet to convert it to a uniform fibrous web, the improvement of including in said layer from 0.1 to 5 phr of a compound $(R'—COO)_nR^2$ in which n has a value 1, 2 or 3, sufficient to satisfy the valence of $R^2$, R′ is an aliphatic hydrocarbon group of 10 to 20 carbon atoms, and $R^2$ is a hydrogen atom or an atom of an alkali metal, alkaline earth metal or aluminum, or an organic radical.

2. Process according to claim 1 wherein said thermoplastic resin is polypropylene; said compound $(R^1—COO)_nR^2$ is present in an amount in the range from 0.2 to 5 phr; $R^1$ is an alkyl radical and $R^2$ is an alkali metal, alkaline earth metal or aluminum.

3. Process according to claim 3 wherein $R^1$ is the undecyl, tridecyl, pentadecyl or heptadecyl group.

4. Process according to claim 2 wherein $R^1$ is heptadecyl and $R^2$ is hydrogen, calcium or aluminum.

5. In the process for the manufacture of fibrous articles which comprises depositing on a surface a layer of powdery particles consisting of at least to the extent of 50% by weight of polypropylene having particle diameters in the range from 5 to 100 μm and from 15 to 50 phr of barium sulfate having particle diameters in the range from 0.1 to 20 μm, maintaining the layer under sufficient heat for a sufficient length of time to form a sheet of partly fused particles and drawing the sheet to convert it to a uniform fibrous web, the improvement of including in said layer from 0.2 to 5 phr of calcium stearate.

* * * * *